US011371803B2

(12) United States Patent
Michal et al.

(10) Patent No.: US 11,371,803 B2
(45) Date of Patent: Jun. 28, 2022

(54) WEAPON INTERFACE PANELS

(71) Applicants: Frank J. Michal, Medina, OH (US); Michael E. Stein, New Philadelphia, OH (US)

(72) Inventors: Frank J. Michal, Medina, OH (US); Michael E. Stein, New Philadelphia, OH (US)

( * ) Notice: Subject to any disclaimer, the term of this patent is extended or adjusted under 35 U.S.C. 154(b) by 0 days.

(21) Appl. No.: 16/522,623

(22) Filed: Jul. 25, 2019

(65) Prior Publication Data

US 2020/0033091 A1 Jan. 30, 2020

Related U.S. Application Data

(60) Provisional application No. 62/703,143, filed on Jul. 25, 2018.

(51) Int. Cl.
*F41C 27/00* (2006.01)
*F41C 23/16* (2006.01)

(52) U.S. Cl.
CPC ..... *F41C 27/00* (2013.01); *F41C 23/16* (2013.01)

(58) Field of Classification Search
CPC ..... F41C 27/00
See application file for complete search history.

(56) References Cited

U.S. PATENT DOCUMENTS

| | | | | |
|---|---|---|---|---|
| 7,856,749 | B2 * | 12/2010 | Fitzpatrick | F41C 23/16 42/85 |
| 8,935,874 | B2 * | 1/2015 | Troy | F41A 35/02 42/90 |
| 9,222,749 | B1 * | 12/2015 | Nakayama | F41C 23/16 |
| 9,964,380 | B1 * | 5/2018 | Oglesby | F41C 23/16 |
| 2012/0311906 | A1 * | 12/2012 | Troy | F41C 23/16 42/71.01 |
| 2016/0116246 | A1 * | 4/2016 | Daniel | F41C 23/16 42/90 |
| 2016/0169610 | A1 * | 6/2016 | Hines | F41C 27/00 42/90 |
| 2016/0216061 | A1 * | 7/2016 | Cheng | F41G 11/005 |
| 2016/0223286 | A1 * | 8/2016 | Storch | F41C 23/16 |
| 2016/0298926 | A1 * | 10/2016 | Jen | F41C 27/00 |
| 2017/0205183 | A1 * | 7/2017 | Ding | F41A 35/02 |
| 2017/0307328 | A1 * | 10/2017 | Shelton | F41C 27/00 |
| 2019/0249948 | A1 * | 8/2019 | Cahill | F41C 27/00 |
| 2019/0249949 | A1 * | 8/2019 | Cahill | F41C 27/00 |

* cited by examiner

*Primary Examiner* — Gabriel J. Klein
(74) *Attorney, Agent, or Firm* — Black, McCuskey, Souers & Arbaugh LPA

(57) ABSTRACT

In an example embodiment, there is disclosed herein a molded panel configured for mounting on a rail of a weapon, the molded panel having a slot that will allowing a cavity to be opened into the panel for allowing a friction fit insert to be inserted into the slot, The friction insert causes the molded panel to be locked onto a rail while the friction fit is inserted into the cavity.

8 Claims, 6 Drawing Sheets

WEAPON INTERFACE PANELS

CROSS REFERENCE TO RELATED APPLICATIONS

This application claims the benefit under 35 U.S.C. § 119 of U.S. Provisional Application No. 62/703,143, filed Jul. 25, 2018. The contents of the aforementioned application is hereby incorporated by reference herein in its entirety.

TECHNICAL FIELD

The present disclosure relates generally to gun accessories, including but not limited to gun covers, grips and gun equipment and accessory mounting and accessory wiring.

BACKGROUND

A principle component of the systems are over molded or mechanically and or chemically bonded clips, bars or rigid internal skeleton components that can be adhered or attached anywhere on a weapon by means of adhesives, hardware or insertion of a rigid structure into the component. Such components can be configured to fit on M4 and M16 carbines, on AR-15 rifles and the like, and on hunting rifles and shot guns or any weapon platform or accessory that may help in the operation of the said platform.

SUMMARY OF EXAMPLE EMBODIMENTS

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein a molded panel configured for mounting on a rail of a weapon, the molded panel having a slot that will allowing a cavity to be opened into the panel for allowing a friction fit insert to be inserted into the slot, The friction insert causes the molded panel to be locked onto a rail while the friction fit is inserted into the cavity.

BRIEF DESCRIPTION OF THE DRAWINGS

The accompanying drawings incorporated herein and forming a part of the specification illustrate the example embodiments.

DESCRIPTION OF EXAMPLE EMBODIMENTS

Figure 1:
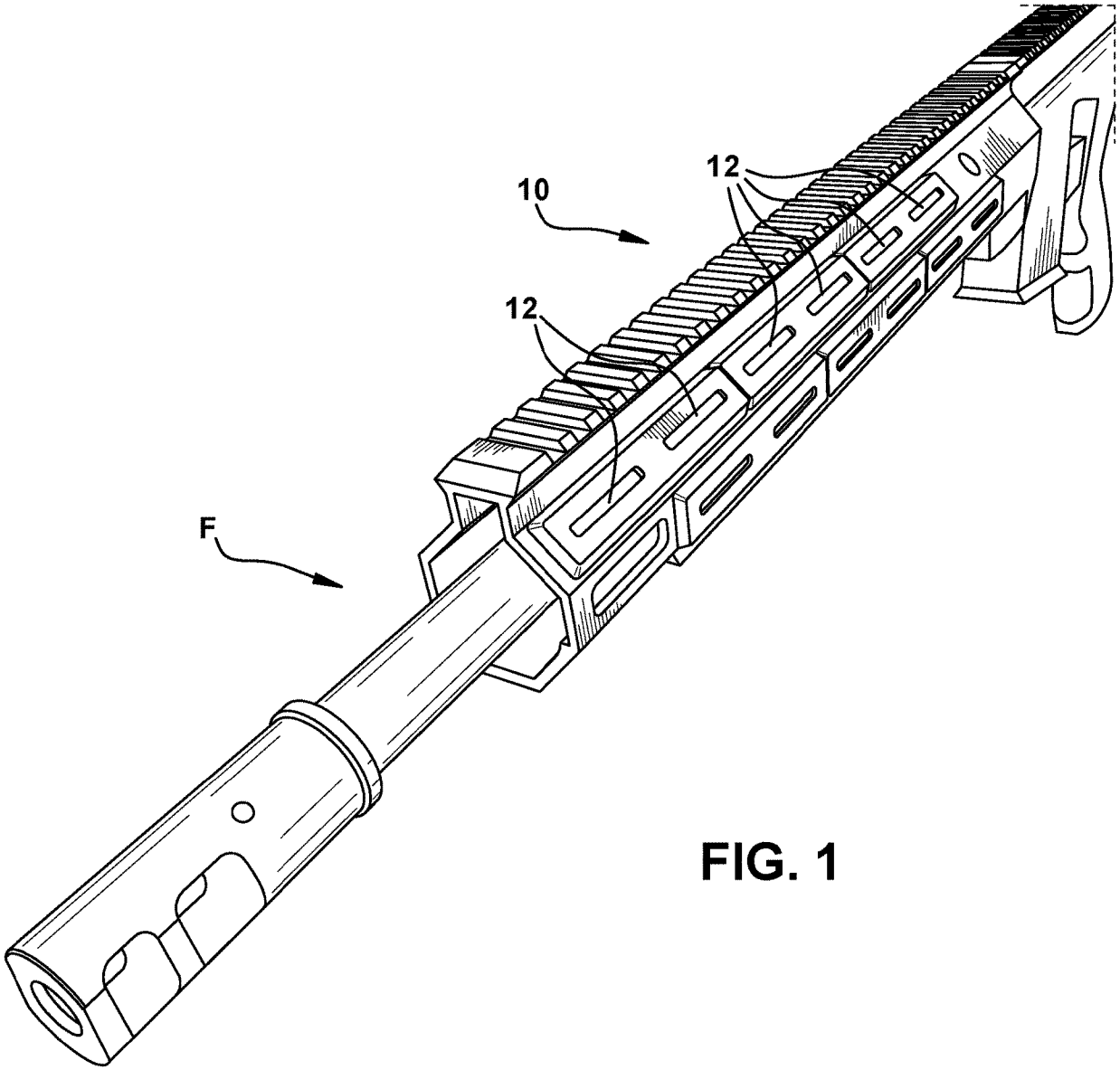
FIG. 1 is an isometric view of a firearm illustrating an example of an implementation of the Mod Lock Panels.

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

Described herein is a weapon interface panel, referred herein as a "Mod Lock Panel," that can be molded out of flexible material such as rubber, silicon, neoprene or any other suitable moldable compound or polymer. The flexibility of the molded material combined with the interior or insert-able skeleton or secondary locking system design reduces recoil and vibration and provides a superior gripping structure. In an example embodiment, a compound, such as rubber, silicon, neoprene or any other suitable moldable compound or polymer, that resists extreme heat and cold temperature fluctuations and will maintain its flexibility and tactile feel in most environments is employed. The ergonomic design of the Mod Lock panels along with the tactile surface ensure the most secure grip, allowing the operator greater control even if conditions are wet.

In an example embodiment the panel can be affixed to the mating surface by an adhesive, screws, bolts, friction inserts or any suitable fastening means. The placement of the panel will help with the operation of weapon or accessory and can provide a more secure grip, mitigate heat and reduce a weapons thermal signature and or protect any surface that it may be attached to or protect any accessory that it may be mounted in conjunction with. The Mod Lock Panel may also provide a means to route or protect wires or pressure pads that are typically utilized on weapon platforms installation. The panels may be in various lengths and numbers and can be installed individually or in sequence and can be cut to length.

Various embodiments of the panels which can be made with or without the internal skeleton include: weapon panels with or without an internal cavity in the form of micro pocket or pockets which are centrally and or laterally disposed and which can receive and hold one or more components including but not limited to switches, wires, lights including LEDs and lasers, batteries, sensors or other devices which may be operatively connected within one or more panels; weapon panel covers with or without internal cavity or cavities; weapon panels with cavities and cooperating components such as rods or connecting rods or pins or electrical connectors which run along a length of the cover or between panels, and each of the weapon panels being manufacturable or modifiable into varying lengths and configurable to be joined in series along the length of a weapon; each of the weapon panel covers being moldable with any exterior configuration, including but not limited to gripping bars arranged transverse to a length of the grip, a central longitudinally ribbed area which may be recessed, distinct or raised features within the central longitudinal area such as a button or other tactile feature, and any other grip configuration or contours or texture; cylindrical or vertical grip which may have an external ribbed configuration or other gripping surface and a planar or curved section in which is formed an internal cavity or pocket which can receive and hold one or more components such as a switch and/or wire and gun rail wire clips also configured to positively engage the mating surface and with or without an internal skeleton component, and an internal cavity for passage of one or more wires in a direction such as aligned with a length of a gun or gun barrel.

The Mod Lock Panels Micro Pocket designs allow for (but is not limited to) the installation of wires and pressure pad membrane tape switches and other objects or devices. The Micro Pockets eliminate the need to glue or tape an unprotected pressure switch to the exterior side of the weapon. Once a pressure pad switch has been positioned in the Micro Pocket it can be activated by pushing on the outside of the Micro Pocket at the point where the switch is located. The user may also choose to install an optional button made out of similar materials that would be applied to the outside of the Micro Pocket directly above the switch. This allows for ease of operation, and as a reference point in low or inhibited visibility conditions. The molded cavity of the Micro Pocket is configured to flex upwards to allow for various thicknesses or objects to be routed within the pocket and rail cover. It also allows for wires to be run coiled or straight within the internal Micro Pocket channel cavity, eliminating the possibility of loose or exposed wires becoming caught or pulled from the weapon. The Mod Lock Panel Design may include (or not include) the Micro Pocket channel in varying heights, widths and configurations to allow objects to interface with, in, on or through the Mod Lock Panel, as further shown and described. The Micro Pocket may be recessed from the exterior surfaces or ribs of the grip for tactile location and to prevent interference from an object or accidental activation a switch or other device contained in the pocket cavity. The Micro Pocket may be formed as a one-piece design or two connecting halves, which form a pocket. The two connecting halves may be installed from each piece joining together from the sides or joining together from the top and bottom. The two-piece design can be two separate pieces or be attached at one or more points forming a hinge. The internal Micro Pocket wire channels can be run parallel to each other on opposing sides of the internal Micro Pocket cavity. These wire channels are expandable to accommodate different wire sizes. The location of the internal wire channels and their circular design allow them to act as a hinge. This hinging action will engage when a thicker item is placed within the center channel cavity. When the center channel cavity cap is stretched upwards the hinging action of the wire channels will start to engage as the pressure from the stretching increases. The flexibility of the center channel Micro Pocket cap and the hinging action of the wire channels will hold items in place that are routed in or through the center Micro Pocket cavity channel.

The Mod Lock Panels come in varying colors and sizes and can be cut, shaped or formed into different lengths or profiles for custom fitment. The Mod Lock Panel will have one or multiple slots that will allow the user to open a hole into the panel allowing a friction fit insert to be inserted into the slots which cause the Mod Lock panel to lock in place onto the rail. This fitment prevents any movement along the mating surface and provides an indexing system for positive location and engagement with the weapon. The Mod Lock Panel Inserts may also come in varying lengths, shapes, and or colors allowing visual and or tactile customization of the Mod Lock Panels.

The Mod Lock panel skeleton can be made from any type of ferrous, non-ferrous, plastic or rigid material. The Mod Lock panel skeleton shape may be able to be conformed prior to or during installation. Optional "Mod Lock Panel Wire Clips or Cross Clips" can also be used in conjunction with the Mod Lock Panel or used alone as a standalone fore end guard and or in wire retention applications. The Mod Lock Panel Wire Clips or Cross Clips will also embody the same materials, components, designs or similar profiles of the Mod Lock Panel and Panel Clips or Cross Clips". The Mod Lock Panel Wire Clips or Cross Clips will allow the user to place the clip on any area of a weapon or the like for wire or accessory retention and protection, and eliminate the danger of loose or unprotected wires on a weapon or surface. Wires or small accessories can be routed through the center wire arch anywhere that the "Mod Lock Wire Clip or cross Clip" can be attached, or have a transverse wire route to hold a wire transverse to the length of a gun or gun barrel. Any of the "Mod Lock Panel" configurations can also be used as indexing points.

The Mod Lock Panels and Mod Lock Panel Clips and Cross Clips may also embody all prior claims stated wherein except the ability to grasp onto a gun, weapon or accessory.

As those skilled in the art can readily appreciate, the example embodiments described herein can provide grip and the means of wires and accessory management on gun equipment, weapons and or any accessory systems which have very strong mechanical or chemical engagement with the mounting surface and improved gripping surfaces and materials, integral pockets or cavities for concealment and containment of accessories such as switches, wiring, batteries, lights or sensors or other devices, and combinations thereof for increased gun utility, safety and performance on weapon platforms that utilize the M-Lok or Key Mod interface mounting systems.

FIG. 1 is an isometric view of a firearm F illustrating an example of an implementation of a Mod Lock Panel 10. Friction fit inserts 12 are inserted into cavities (see e.g., FIG. 4, also referred to herein as "carrot pockets") via slots which cause the Mod Lock Panel 10 to lock in place onto the rail.

Figure 2:
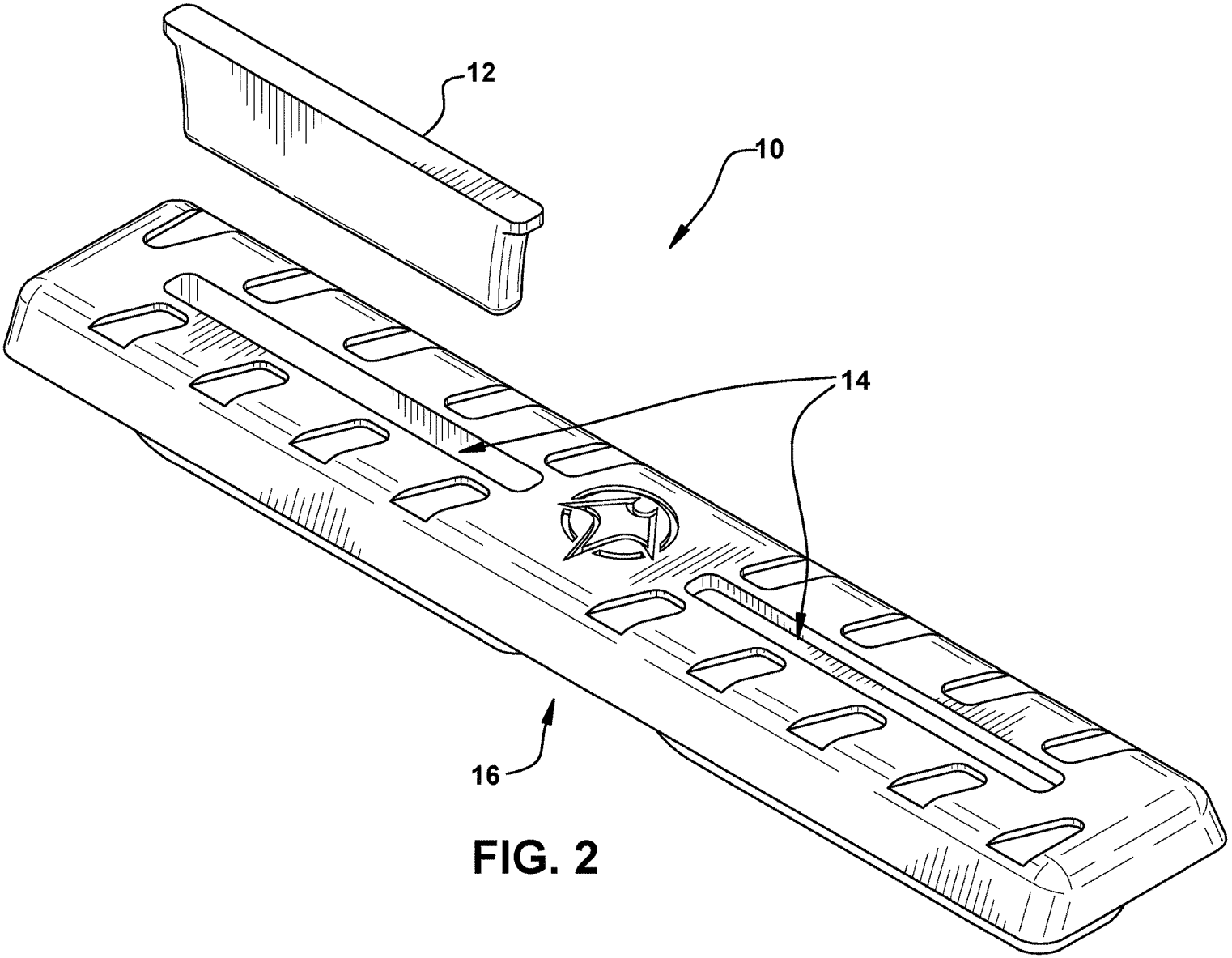
FIG. 2 is an explode view of a Mod Lock Panel.

FIG. 2 is an explode view of a Mod Lock Panel 10. This view illustrates the top 16 of the Mod Lock Panel with the inserts 12 outside of the cavities (or carrot pockets, see e.g., FIG. 4) Although this view shows a single insert 12 for two carrot pockets, those skilled in the art can readily appreciate that inserts may be placed in one or both cavities or "carrot pockets." The top 16 of the Mod Lock Panel 10 comprises slots 14 for providing access for the inserts 12 into the cavities.

Figure 3:
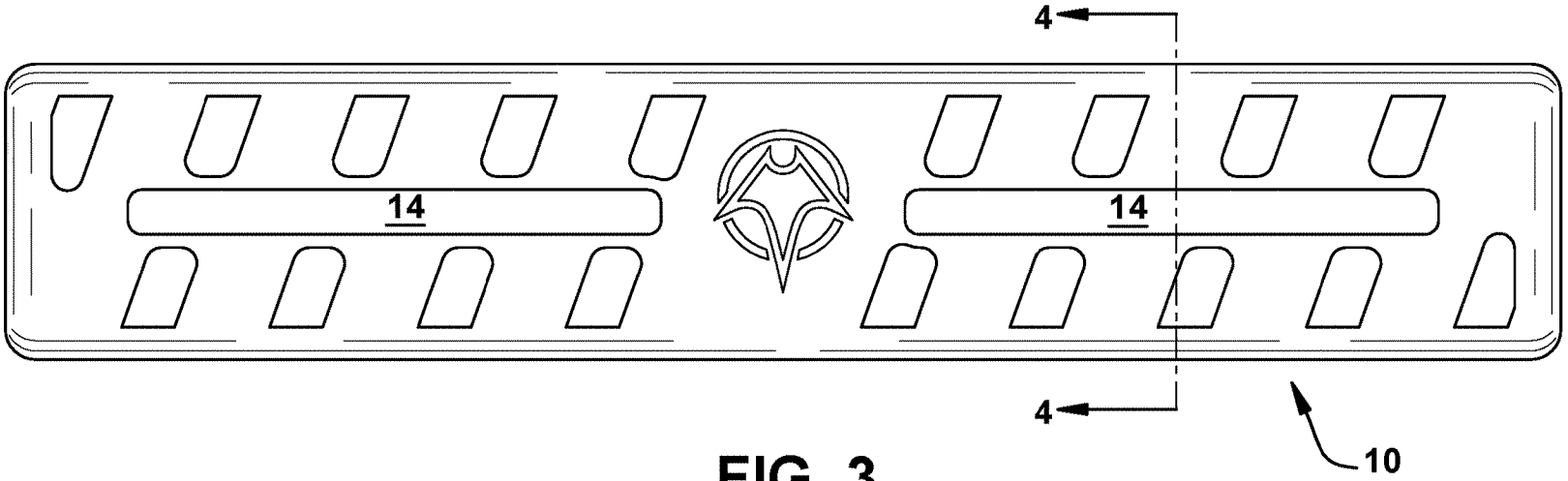
FIG. 3 illustrates a top view of the Mod Lock Panel.

FIG. 3 illustrates a top view of the Mod Lock Panel 10. The illustrated example has two slots 14, however, those skilled in the art should realize that the Mod Lock Panel 10 may suitably comprise any physically realizable number of slots 14.

Figure 4:
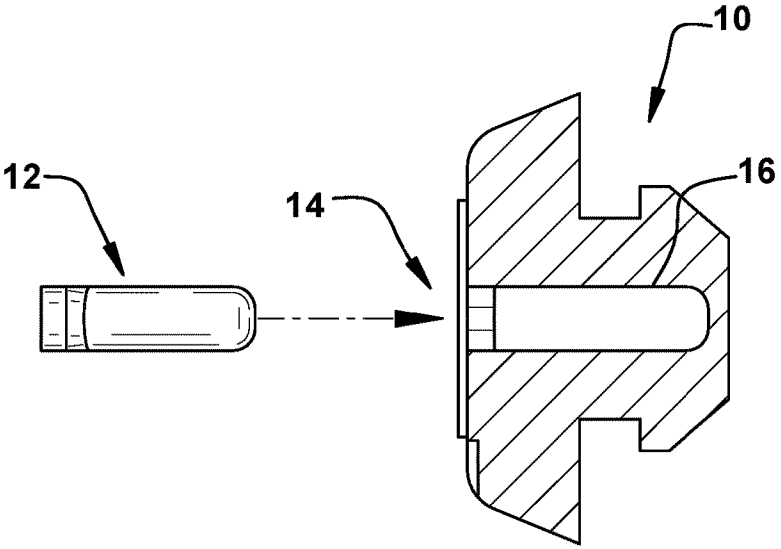
FIG. 4 is an exploded view along axis A-A of FIG. 3.

FIG. 4 is an exploded view along axis A-A of FIG. 3. The insert 12 is inserted into the cavity or carrot pocket 16 of the Mod Lock Panel 10 via the slot 14 as indicated by the dotted line between the insert 12 and the Mod Lock Panel 10. In an example embodiment, the insert 12 is made of a material that expands and thus further locks the Mod Lock Panel 10.

Figure 5:
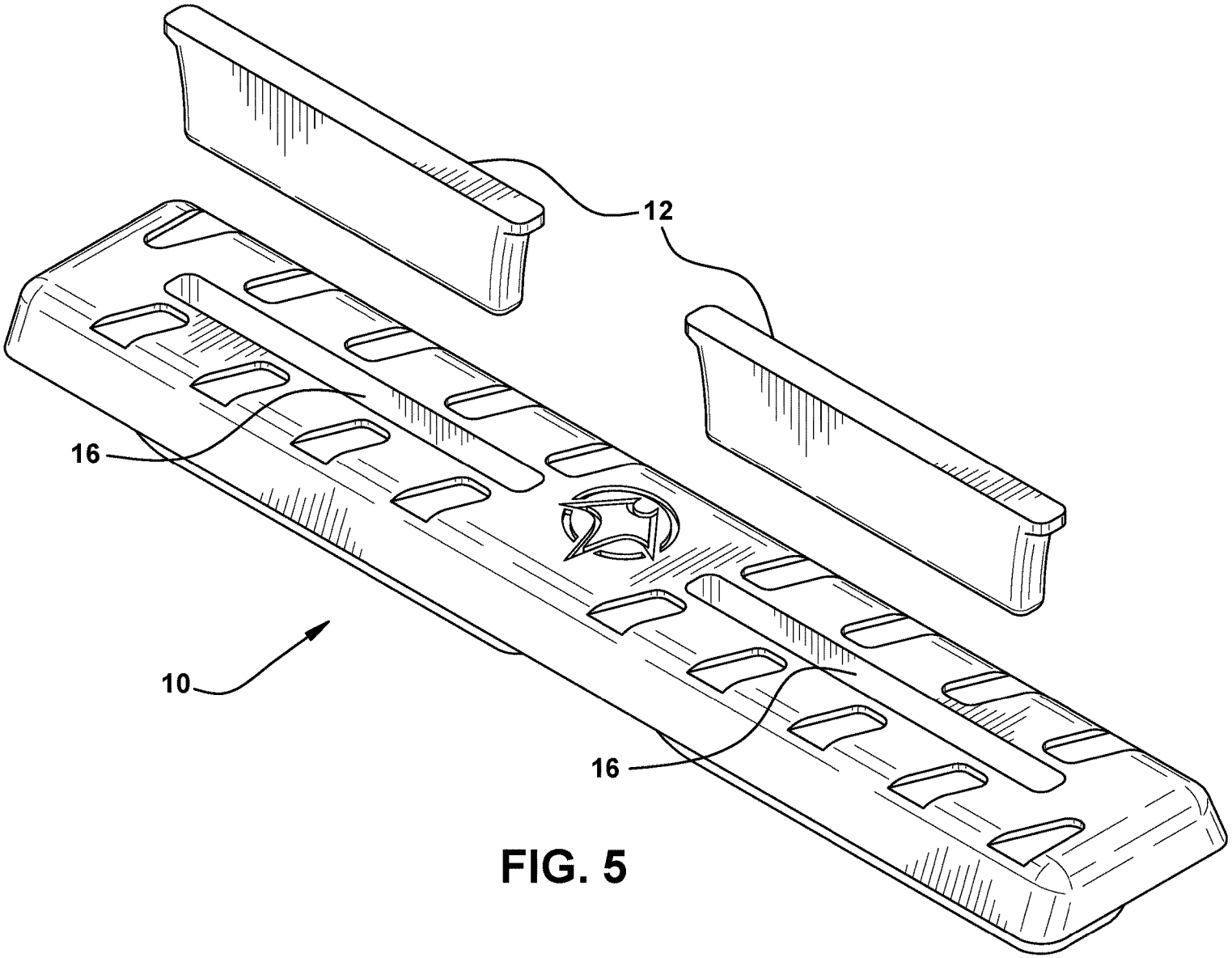
FIG. 5 is an isometric view of a Mod Lock Panel.

FIG. 5 is an isometric view of a Mod Lock Panel 10. In this example, the inserts 12 have been removed from the cavities 16.

Figure 6:
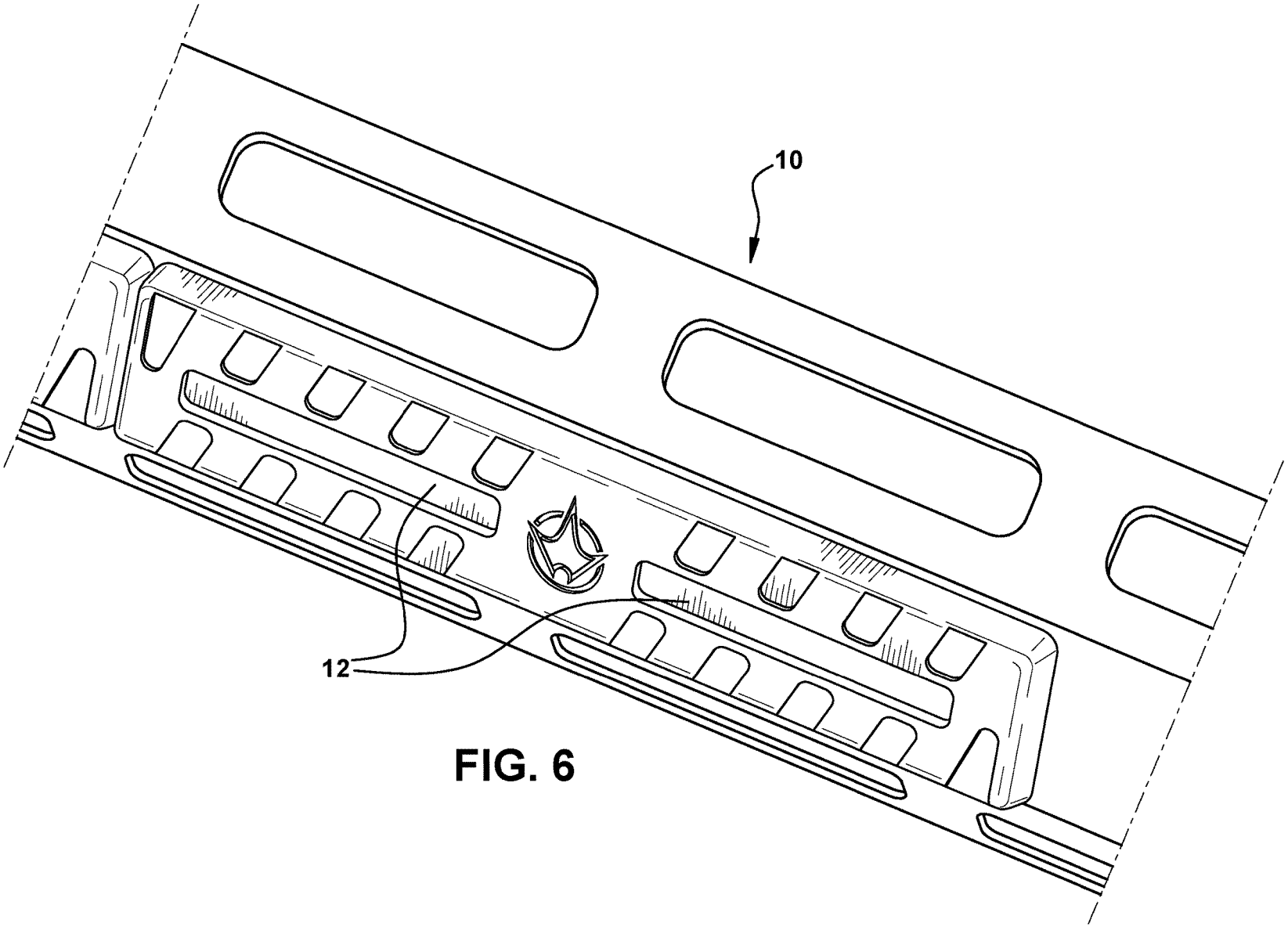
FIG. 6 is a top view of a Mod Lock Panel.

FIG. 6 is a top view of a Mod Lock Panel 10. In this illustration, the inserts 12 are installed into the cavities (carrot pockets).

Figure 7:
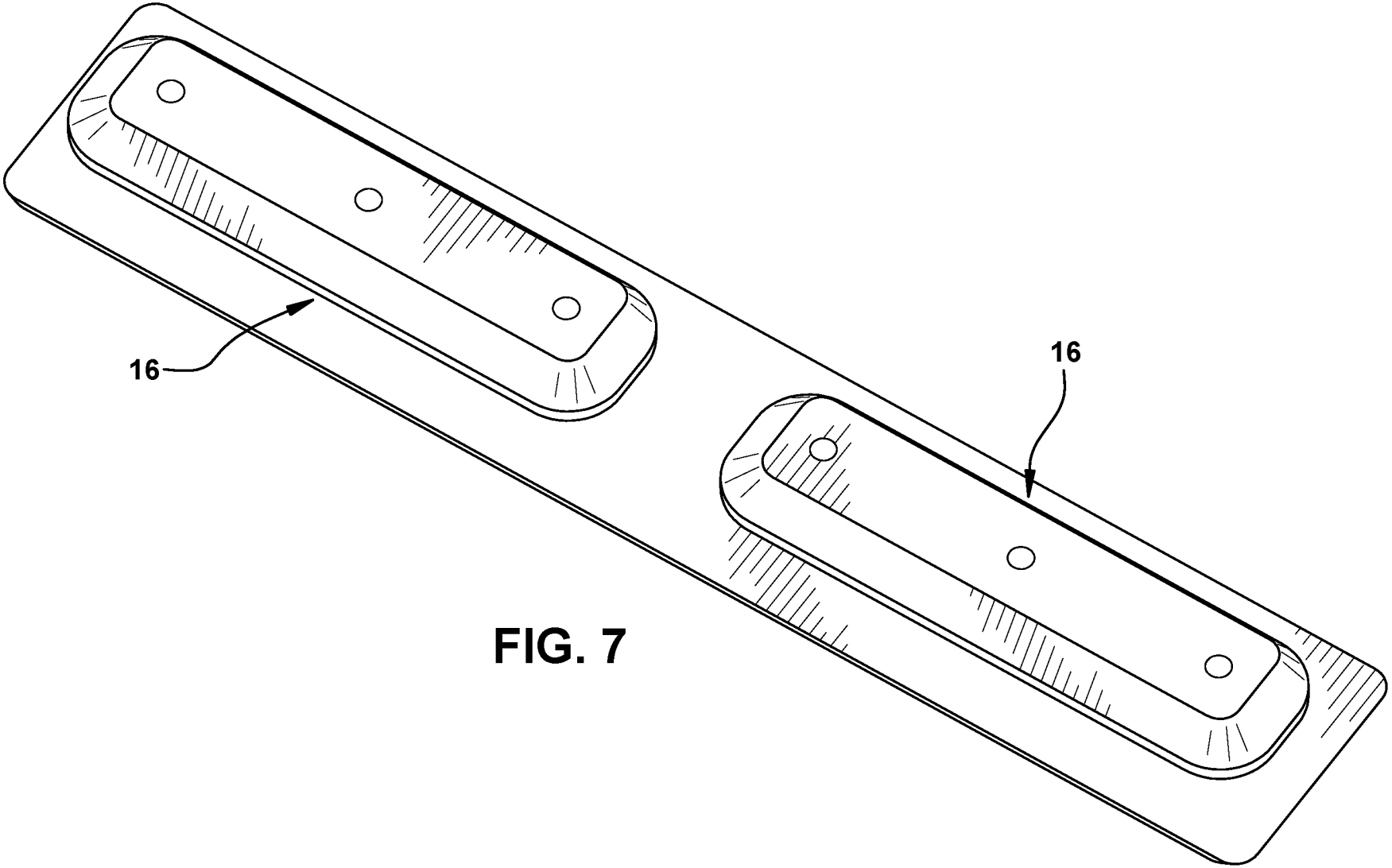
FIG. 7 is an example illustration of a bottom view of the Mod Lock Panel.

FIG. 7 is an example illustration of a bottom view of the Mod Lock Panel 10. This view illustrates an example of the cavities or "Carrot Pockets" 16.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

The invention claimed is:

1. An apparatus, comprising:

a molded panel configured for mounting on a rail of a weapon, the molded panel having a blind pocket with a single slot that provides access into the interior of the blind pocket, wherein the molded panel is mounted on the rail with the slot facing away from the weapon such that the blind pocket is accessible from an exterior of the rail; and a rectangular, substantially planar friction fit insert inserted into the slot;

wherein the friction fit insert locks the molded panel onto the rail.

2. The apparatus set forth in claim 1, wherein the molded panel is configured to be affixed to a mating surface.

3. The apparatus set forth in claim 1, wherein the molded panel is molded out of a material selected from a group consisting of rubber, silicon, and neoprene.

4. The apparatus set forth in claim 1, wherein the material is a thermally insulating material.

5. An apparatus, comprising:

a molded panel configured for mounting on a rail of a weapon, the molded panel comprises a first blind pocket having a single, first slot and a second blind pocket having a single, second slot;

a first rectangular, substantially planar friction fit insert that is inserted into the first slot; and a second rectangular, substantially planar friction fit insert that is inserted into the second slot;

wherein the molded panel is mounted onto the rail with the first and second slots facing away from the weapon such that the first and second blind pockets are accessible from an exterior of the rail and the molded panel is locked onto the rail by the first friction fit insert and the second friction fit insert.

6. The apparatus set forth in claim 5, wherein the molded panel is molded out of a material selected from a group consisting of rubber, silicon, and neoprene.

7. The apparatus set forth in claim 6, wherein the material is a thermally insulating material.

8. The apparatus set forth in claim 5, wherein the first and second friction fit inserts fill the first and second slots respectively.

* * * * *